US011859872B2

(12) United States Patent
Varga et al.

(10) Patent No.: US 11,859,872 B2
(45) Date of Patent: Jan. 2, 2024

(54) VARIABLE GEOMETRY EJECTOR FOR COOLING APPLICATIONS AND COOLING SYSTEM COMPRISING THE VARIABLE GEOMETRY EJECTOR

(71) Applicants: UNIVERSIDADE DO PORTO, Oporto (PT); INEGI—INSTITUTO DE ENGENHARIA MECÂNICA E GESTÃO INDUSTRIAL, Oporto (PT)

(72) Inventors: Szabolcs Varga, Oporto (PT); Armando Carlos Figueiredo Coelho De Oliveira, Oporto (PT); Fernando Gomes De Almeida, Oporto (PT); António Manuel Ferreira Mendes Lopes, Oporto (PT); João Pedro Barata Rocha Falcão Carneiro, Oporto (PT)

(73) Assignees: Universidade Do Porto; Inegi-Instituto De Engenharia Mecanica E Gestao Industrial

( * ) Notice: Subject to any disclaimer, the term of this patent is extended or adjusted under 35 U.S.C. 154(b) by 207 days.

(21) Appl. No.: 17/265,008

(22) PCT Filed: Aug. 1, 2019

(86) PCT No.: PCT/PT2019/050026
§ 371 (c)(1),
(2) Date: Feb. 1, 2021

(87) PCT Pub. No.: WO2020/027680
PCT Pub. Date: Feb. 6, 2020

(65) Prior Publication Data

US 2022/0113063 A1 Apr. 14, 2022

(30) Foreign Application Priority Data

Aug. 1, 2018 (PT) ..... 110900

(51) Int. Cl.
*F25B 1/06* (2006.01)

(52) U.S. Cl.
CPC ..... *F25B 1/06* (2013.01); *F25B 2341/0012* (2013.01); *F25B 2500/01* (2013.01)

(58) Field of Classification Search
CPC .... F25B 9/04; F25B 9/065; F25B 1/06; F25B 2341/0012
See application file for complete search history.

(56) References Cited

U.S. PATENT DOCUMENTS 3,701,264 A * 10/1972 Newton ..... F25B 41/00 62/191
3,922,877 A * 12/1975 Ophir ..... F25B 1/08 62/239

(Continued)

FOREIGN PATENT DOCUMENTS

CN 104676957 A 6/2015
EP 1160522 A1 12/2001

(Continued)

OTHER PUBLICATIONS

International Search Report, PCT/PT2019/050026 dated Dec. 18, 2019.

*Primary Examiner* — David J Teitelbaum
(74) *Attorney, Agent, or Firm* — Calderone Bullock LLC

(57) ABSTRACT

A variable geometry ejector (300) for cooling applications is disclosed comprising a primary fluid chamber (302); a suction chamber (320) downstream the primary fluid chamber (302); a primary nozzle (310) arranged so as to stream a working fluid from the primary fluid chamber (302) to the suction chamber (320); and a tail member (325) arranged downstream the primary nozzle (310), wherein any of the primary nozzle (310) and the tail member (325) is movable in relation to the other. The invention further discloses a (Continued)

system comprising the variable geometry ejector (300). The invention applies to cooling apparatus and systems industry.

10 Claims, 7 Drawing Sheets

(56) References Cited

U.S. PATENT DOCUMENTS

| | | | | |
|---|---|---|---|---|
| 4,173,994 | A | 11/1979 | Hiser | |
| 6,904,769 | B2 | 6/2005 | Ogata et al. | |
| 6,966,199 | B2 | 11/2005 | Takeuchi | |
| 7,779,647 | B2 | 8/2010 | Takeuchi et al. | |
| 8,047,018 | B2 | 11/2011 | Ikegami et al. | |
| 2004/0172966 | A1* | 9/2004 | Ozaki | F25B 9/008 62/500 |
| 2008/0118371 | A1 | 5/2008 | Vasquez et al. | |
| 2013/0239600 | A1* | 9/2013 | Verma | F04F 5/46 239/589 |
| 2016/0186783 | A1 | 6/2016 | Nishijima et al. | |
| 2017/0102010 | A1* | 4/2017 | Cheong | F04F 5/463 |
| 2018/0274821 | A1* | 9/2018 | Lee | F25B 1/06 |

FOREIGN PATENT DOCUMENTS

| | | | |
|---|---|---|---|
| EP | 3156745 | A1 | 4/2017 |
| GB | 2033011 | A | 5/1980 |
| WO | 2013003179 | A1 | 1/2013 |
| WO | 2017198948 | A1 | 11/2017 |

* cited by examiner

VARIABLE GEOMETRY EJECTOR FOR COOLING APPLICATIONS AND COOLING SYSTEM COMPRISING THE VARIABLE GEOMETRY EJECTOR

FIELD OF THE INVENTION

The present invention relates to a variable geometry ejector for cooling applications. It further relates to a cooling system comprising said variable geometry ejector. The present invention applies to cooling apparatus and systems industry.

BACKGROUND OF THE INVENTION

An ejector cooling cycle is a thermodynamic cycle where the energy required to run a system is mostly supplied in the form of heat in a vapour generator. This heat is transferred to the motive (or primary) stream of a working fluid at relatively high pressure. The pressure energy of the motive stream is then converted into kinetic energy in the primary nozzle of an ejector by supersonic expansion to a low pressure. As a result of the expansion process, a secondary stream coming from an evaporator of the cooling cycle is entrained. The interaction and mixing between the motive and secondary streams result in an increase of the kinetic energy of the secondary flow which is converted into pressure energy by adequate design of the ejector cross-section. Thus, the main function of the ejector is to compress the secondary stream from a lower inlet pressure to a higher exit pressure using the energy of the motive stream.

The prior art ejectors operating in cooling cycles typically have a fixed geometry. Therefore, these ejectors operate with good efficiency only under a single design operating condition. Deviation from the design condition negatively influences the ejector cooling performance or eventually leads to system failure. In other words, different inlet and outlet temperatures/pressures require different ejector geometries.

Accordingly, applications involving for example variable inlet temperatures do not work properly with such fixed geometry ejectors. By way of example, applications such as air conditioning systems using solar thermal energy as the primary energy source are not suitable to work with these known ejectors due to the considerable variability of the energy source and the environmental conditions.

The current solution in the art to achieve optimal operation under variable operating conditions is to use a multiple ejector system. However, this involves a great deal in system size and complexity with a negative impact on the installation, operation and maintenance costs.

As such, there is a need in the art for an ejector designed such that it overcomes the above-mentioned drawbacks.

U.S. Pat. No. 4,173,994 to Hiser, shows an ejector cycle-based cooling and heating apparatus. The ejector has a fixed geometry design, thus in order to compensate the performance decrease due to variable operating conditions, a conventional vapour compressor is connected in parallel to the ejector. This solution increases initial equipment costs and reduces the efficiency when using solar energy to run the cooling cycle.

In EP 1160522 A1 an ejector cycle system for cooling applications is presented. The ejector has a fixed geometry, although it can embody more multiple nozzles. The flow inside the ejector is biphasic and a mechanical vapour compressor is used in the cooling cycle. The inclusion of a vapour compressor adds technical complexity and increases the electric energy consumption of the system, thus increasing the associated costs of production and operation.

In U.S. Pat. No. 6,966,199 B2 an ejector is shown with controllable nozzle, using a needle valve in the primary nozzle of the ejector that extends through the nozzle exit cross-section. The needle valve extending from the nozzle exit cross-section is moved by an axial actuator. For the proper operation of the ejector cycle, a vapour compressor is needed for compressing and discharging the refrigerant, which increases the electric energy consumption of the system.

In U.S. Pat. No. 6,904,769 B2 a needle is applied in the ejector nozzle in order to simultaneously change the cross-sectional size of the nozzle outlet and the constant area section size. Because of the presence of the needle valve in the high velocity part of the ejector, this configuration leads to unwanted frictional losses and shock phenomena near the needle wall surface. The ejector is part of a vapour compression system relying on a vapour compressor, with the above-mentioned drawbacks involved.

In U.S. Pat. Nos. 7,779,647 B2 and 8,047,018 B2, an ejector is incorporated in a vapour compression refrigeration system typically used for a vehicle air conditioner. The ejector performs pressure reducing means and circulating means for circulating the refrigerant downstream the radiator. In U.S. Pat. No. 7,779,647 B2, a needle is used to control the passage area of the nozzle part. A refrigerant outflow branch is coupled to the nozzle part to redirect a portion of the refrigerant to the evaporator of the cooling cycle. In this way the expansion work can be partially recovered. Thus, in this arrangement the ejector works as an expansion work recovery device.

A two-phase ejector is used in WO 2013/003179 A1 in a refrigeration machine for recovering expansion work in a vapour compression system. This system also uses a mechanical compressor as principal means of vapour compression. The exemplary ejector is two-phase with $CO_2$ refrigerant which is in supercritical state at the primary inlet. It is stated that the ejector can be a controllable type, with a needle extending into the nozzle throat.

In Chinese patent CN104676957 a traditional throttle of a vapour compression system is replaced with an adjustable ejector. The system incorporates the adjustable ejector and other means of vapour compression. In the power nozzle of the ejector a regulating pin is employed to adjust the power nozzle cross-sectional area. The position of the regulating pin is adjusted using a threaded connection and it is based on the measurement of the storage temperature, computation of the storage efficiency and target values.

In US Patent 2016/0186783 A1 an ejector is used for a vapour compression refrigeration system in order to reduce the power consumption of the mechanical compressor. The mechanical compressor is the principal means for compressing the refrigerant before entering the condenser (radiator). The flow inside the ejector is in gas-liquid two-phase state. The ejector can comprise a valve body inside the converging nozzle portion to change the refrigerant passage cross section area. The needle valve is placed in the converging nozzle part and extends from the nozzle portion to the refrigerant injection port. This needle valve is described as a tapered shaped centre axis needle valve, tapered toward the downstream side in the refrigerant flow. No specific details are given about the taper shape of the needle and its specific function.

The prior art cooling systems comprising fixed geometry ejectors require additional mechanical means of vapour compression. These solutions increase the complexity of the systems and the inherent cost thereof.

In particular, there is a need in the art for technical means for thermal vapour compression of a refrigerant fluid in a cooling cycle using a single ejector. In other words, there is a need for a cooling cycle system which does not require the use of multiple mechanical vapour compression means.

The present invention aims to overcome the above-mentioned drawbacks.

SUMMARY OF THE INVENTION

The present invention relates to a variable geometry ejector (300) for cooling applications comprising:

- a primary fluid chamber (302),
- a suction chamber (320) downstream the primary fluid chamber (302),
- a primary nozzle (310) arranged so as to stream a working fluid from the primary fluid chamber (302) to the suction chamber (320), and
- a tail member (325) arranged downstream the primary nozzle (310),
- characterized in that any of the primary nozzle (310) and the tail member (325) is movable in relation to the other.

In particular, the variable geometry ejector (300) comprises an NXP-adjustment means for moving any of the primary nozzle (310) and the tail member (325) in relation to the other.

Said NXP-adjustment means is selected from the group comprising mechanical actuator, electric actuator, electronic actuator, hydraulic actuator, pneumatic actuator and combinations thereof.

In an embodiment the NXP-adjustment means comprises an actuator plate (370) attached to movable actuation bars (375), and a motor (380) connected to the bars (375).

In a further embodiment, the NXP-adjustment means further comprises a movable motor shaft plate (377) connected to a rotating shaft (376) of the motor (380) and connected to the actuation bars (375).

According to a preferred embodiment, the primary fluid chamber (302) is provided with a primary fluid inlet port (309), and the suction chamber (320) is provided with a secondary fluid inlet port (319); the primary nozzle (310) comprises a primary tapered converging section (311), a throat (312) and a tapered divergent exit section (313) ending at a nozzle exit (314); and the tail member (325) comprises a secondary tapered converging section (330), a constant area section (340) and a diffuser section (350).

In another embodiment, the variable geometry ejector (300) further comprises an $r_A$-shifting means (308) arranged upstream the primary nozzle (310). Preferably, the $r_A$-shifting means (308) is a movable spindle. More preferably, said spindle (308) is axially movable between a first position in which a spindle tip (304) is arranged outside the tapered converging section (311) of the primary nozzle (310), and a second position in which the spindle tip (304) is inside the nozzle throat (312) blocking it. In a particular aspect, said spindle tip (304) has two different angled parts.

In a still further embodiment, the variable geometry ejector (300) comprises an $r_A$-shifting means (308) arranged upstream the primary nozzle (310) and an NXP-adjustment means arranged for moving the tail member (325) in relation to the primary nozzle exit (314) of the primary nozzle (310).

The present invention also relates to an ejector system comprising a variable geometry ejector (300) of the invention.

In an embodiment the ejector system further comprises a control unit (800) and a vapour generator (210), a condenser (700), a vapour separator (400), an expansion valve (500), an evaporator (600), a liquid pump (110) and piping.

BRIEF DESCRIPTION OF THE DRAWINGS

Description of the details and operation of the invention will be more readily understandable when taken together with the accompanying drawings, in which.

DETAILED DESCRIPTION OF THE INVENTION

In view of the above-mentioned problems, it is one object of the present invention to provide a variable geometry ejector (VGE) which can efficiently operate, without failure, in a wider range of operating conditions than conventional fixed geometry devices.

It is another object of the present invention to provide a cooling system operating under an ejector cycle, the system using a single variable geometry ejector of the invention without the need for additional mechanical vapour compression means. With the system of the present invention, the refrigerant flow inside the ejector is kept in single vapour phase.

Ejector performance in a cooling cycle can be measured by the coefficient of performance (COP) and the critical back pressure. The COP is a measure of the useful cooling capacity in relation to the rate of energy input. The critical back pressure is the maximum pressure at the ejector outlet for which the secondary stream flow rate is constant provided that the motive fluid state at the ejector primary nozzle is unchanged. Optimal ejector operation is the one that provides the highest possible COP and is near its critical back pressure.

Figure 4:
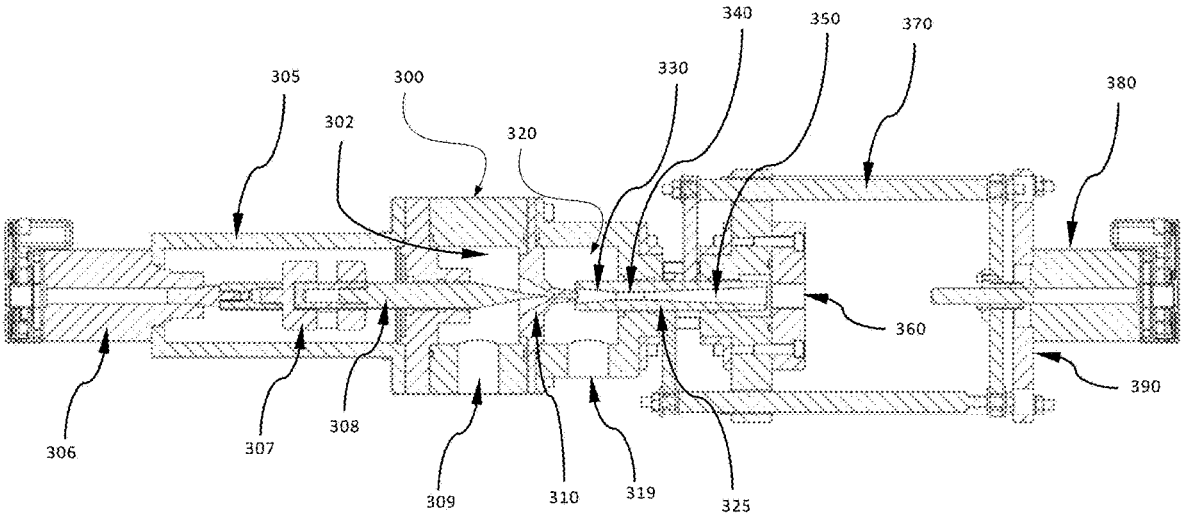
FIG. 4 is a cross-section view of a preferred embodiment of the variable geometry ejector of the invention.
Figure 5:
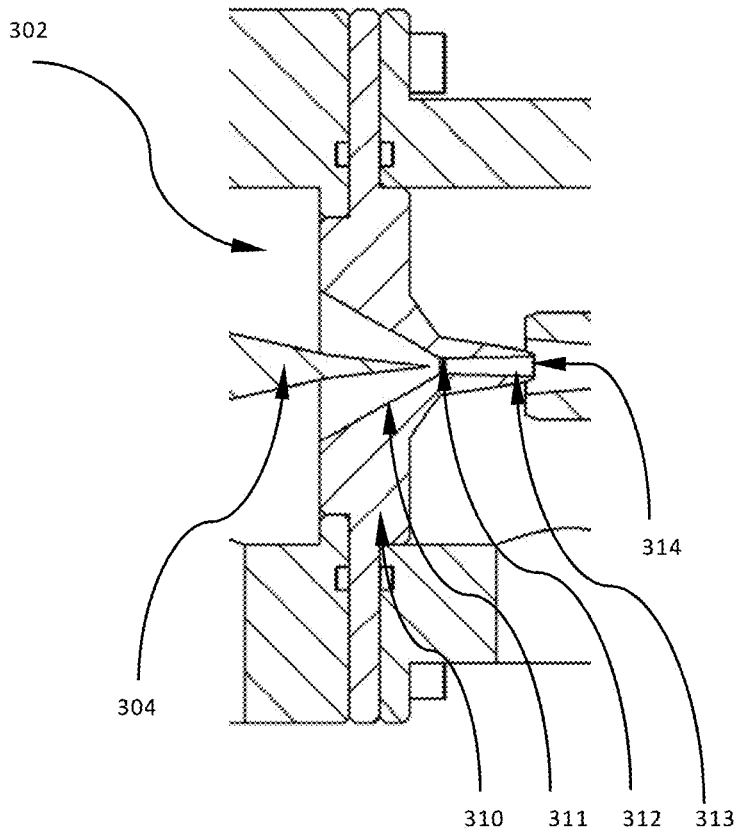
FIG. 5 is a detail of the primary nozzle of the ejector of FIG. 4.

According to the present invention and making reference to FIGS. 4 and 5, the variable geometry ejector (300) of the invention comprises a primary fluid chamber (302); a suction chamber (320) downstream the primary fluid chamber (302); a primary nozzle (310) arranged so as to stream a working fluid from the primary fluid chamber (302) to the suction chamber (320); and a tail member (325) arranged downstream the primary nozzle (310); wherein any of the primary nozzle (310) and the tail member (325) is movable in relation to the other.

Surprisingly, it has been found that by varying a geometric factor relying on the primary nozzle exit position (also reading NXP hereinafter), the above-mentioned effects and advantages are met, since it has been found that NXP affects both COP and the critical back pressure. In practice, making any of the primary nozzle (310) and the tail member (325) movable in relation to the other allows to adjust said NXP, thus achieving the desired technical effects.

In a preferred embodiment, the primary fluid chamber (302) is provided with a primary fluid inlet port (309), while the suction chamber (320) is provided with a secondary fluid inlet port (319); the primary nozzle (310) comprises a primary tapered converging section (311), a throat (312) and a tapered divergent exit section (313) ending at a nozzle exit (314); and the tail member (325) comprises a secondary tapered converging section (330), a constant area section (340) and a diffuser section (350).

The primary nozzle (310) is arranged so as to allow communication of a working fluid from the primary fluid chamber (302) to the suction chamber (320).

In operation, the primary nozzle (310) defines the flow path of a primary (or motive) stream, and the tail member (325) is the member of the variable geometry ejector (300) where the expanded primary stream (from the primary nozzle) entrains a secondary (or suction) stream of a working fluid, which is therein compressed and then discharged to a condenser. The operation of the preferred embodiment of the invention is explained in more detail herein below.

An NXP-adjustment means is arranged for moving any of the primary nozzle (310) and the tail member (325) in relation to the other.

In the preferred embodiment, the NXP-adjustment means is designed for the active and independent changing of the free cross-section for the secondary stream in the tapered converging section (330) of the tail member (325). In this case, such adjustment is achieved by changing the position of the tail member (325) in relation to the primary nozzle exit (314). Actuators are used for adjusting the NXP by acting along the axial direction of the variable geometry ejector (300).

Preferably, the NXP-adjustment means is selected from the group comprising mechanical actuator, electric actuator, electronic actuator, hydraulic actuator, pneumatic actuator and combinations thereof.

Figure 8:
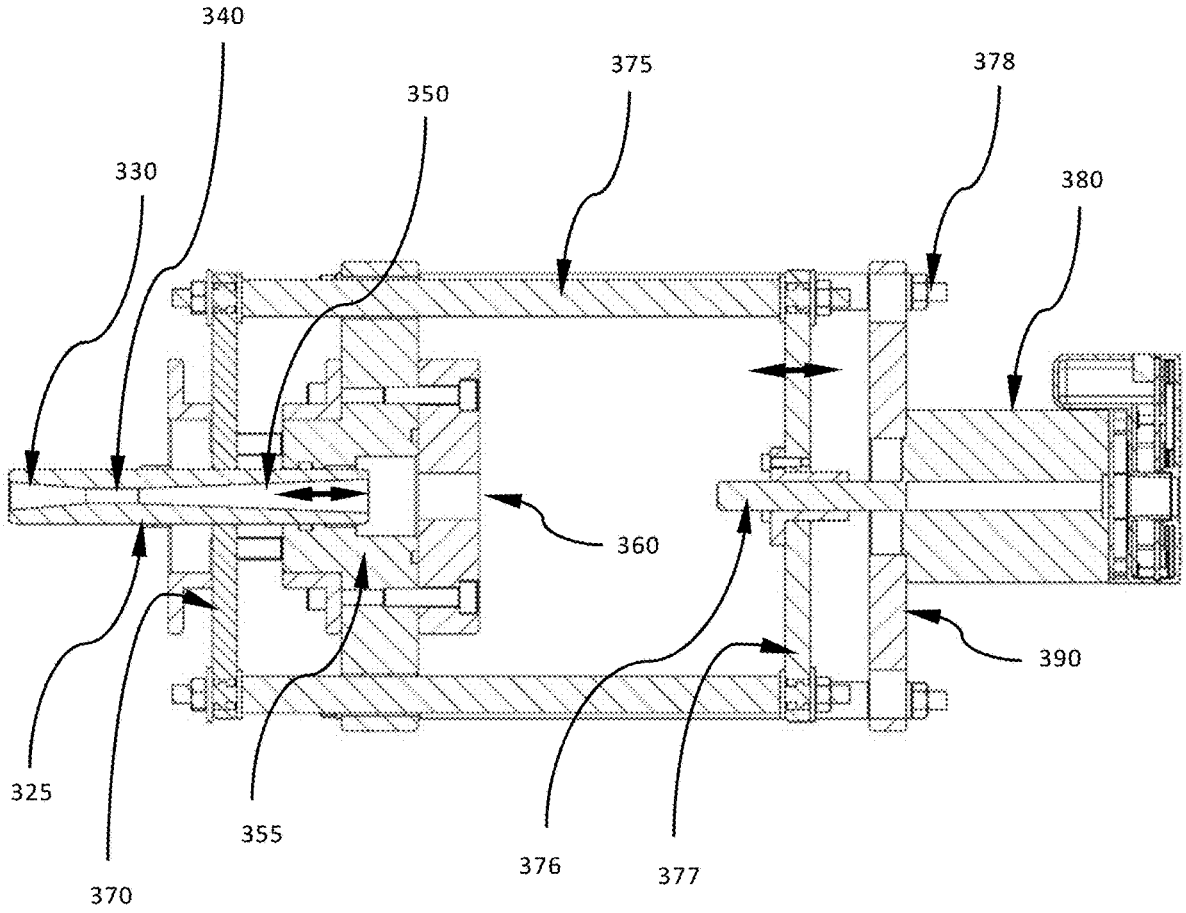
FIG. 8 is a detail of a preferred mechanism for adjusting the nozzle exit position in the variable geometry ejector of FIG. 4.

Making reference to FIG. 8, the NXP-adjustment means comprises an actuator plate (370) attached to movable actuation bars (375), and a motor (380) connected to the bars (375).

In the preferred embodiment of FIG. 8, the NXP-adjustment means comprises an actuator plate (370) attached to movable actuation bars (375), and a motor (380) connected to the bars (375) by means of a movable motor shaft plate (377) which also is connected to a rotating shaft (376) of the motor (380).

Different embodiments of the NXP-adjustment means may be designed by the person skilled in the art without departing from the present invention.

Preferably, the variable ejector (300) further comprises an $r_A$-shifting means (308) arranged upstream the primary nozzle (310).

The $r_A$-shifting means (308) allows to vary an area ratio (reading $r_A$ herein) between the constant area section (340) of the tail member (325) and the primary nozzle throat (312). An increase of the area ratio ($r_A$) increases the COP and simultaneously decreases the critical back pressure, and thus an optimal value may be achieved depending on the operating conditions.

By providing the variable ejector (300) of the invention with the means for varying both of these two mentioned geometrical factors: $r_A$ and NXP, the performance of the ejector (300) under variable operating conditions considerably improves.

The expansion process of the motive stream downstream the primary nozzle exit section (313) also depends on the operating conditions. By adjusting the primary nozzle exit position (NXP) in the tapered converging section (330) of the tail member (325), the free cross-section for the secondary stream can be controlled.

In a preferred embodiment the area ratio-shifting means (308) is a movable spindle. Said spindle is arranged in the high pressure low velocity side of the primary nozzle (310). In this embodiment, an actuator acting on the spindle changes the spindle axial position relative to the nozzle throat (312). The shape of the spindle is designed such that it provides fine tuning of the optimal area ratio ($r_A$).

More specifically, said spindle (308) is axially movable between a first position in which a spindle tip (304) is arranged outside the tapered converging section (311) of the primary nozzle (310), and a second position in which the spindle tip (304) is inside the nozzle throat (312) blocking it. This arrangement provides for a displacement of the spindle between the first position in which the nozzle throat (312) is completely open and the second position in which the nozzle throat (312) is fully closed to the primary stream of the working fluid.

Preferably, said spindle tip (304) has two different angled parts, as better explained below in connection with the description of the preferred embodiment. This arrangement provides an improved functioning of the spindle.

It is another object of the invention to provide an ejector system for cooling applications. The system comprises a variable geometry ejector (300) of the invention. The system can operate under a simple cooling cycle with a reduced number of components that can be cost-effectively integrated for example into a solar thermal energy driven air conditioner.

Figure 3:
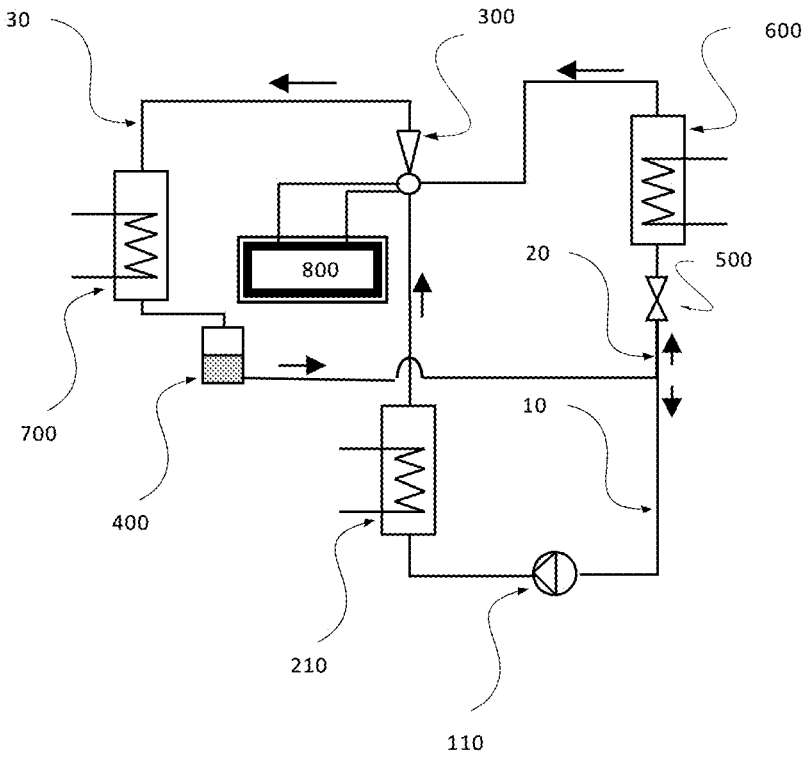
FIG. 3 shows a schematic diagram of a cooling cycle system designed to be used with the variable geometry ejector of the invention.

With reference to FIG. 3, a particular embodiment for the ejector system comprises a variable geometry ejector (300) of the invention. It further comprises a vapour generator (210), a condenser (700), a vapour separator (400), an expansion valve (500), an evaporator (600), a liquid pump (110), piping and a control unit (800).

The control unit (800) provides for an automated control of one or both of said $r_A$-shifting and NXP-adjustment means. This assures an efficient control of said area ratio ($r_A$) and/or primary nozzle exit position (NXP).

The control unit comprises instrumentation, hardware and software. The instrumentation of the control unit comprises pressure/temperature sensors at the inlets and outlet of the variable geometry ejector and flow meters. Hardware components are selected from the group comprising personal computer or motherboard, frequency inverter, data logger, actuators, and the like and combinations thereof. Software components may include supervised learning or unsupervised learning artificial neural network algorithms or others.

The present invention is particularly suitable to be installed in air conditioning systems using solar thermal energy as the primary energy source, due to the considerable variability of the energy source and the environmental conditions. It provides efficient operation of the cooling cycle since it actively adapts its geometry to the operating conditions.

A number of different working fluids are suitable to be used in connection to the present invention. These working fluids are selected from the group comprising R600a, R290, RC318, R134a, R152a, R600, R245fa, water and the like and combinations thereof.

DESCRIPTION OF THE PREFERRED EMBODIMENT

The preferred embodiment of the present invention will be herein described with reference to the accompanying drawings.

Figure 1:
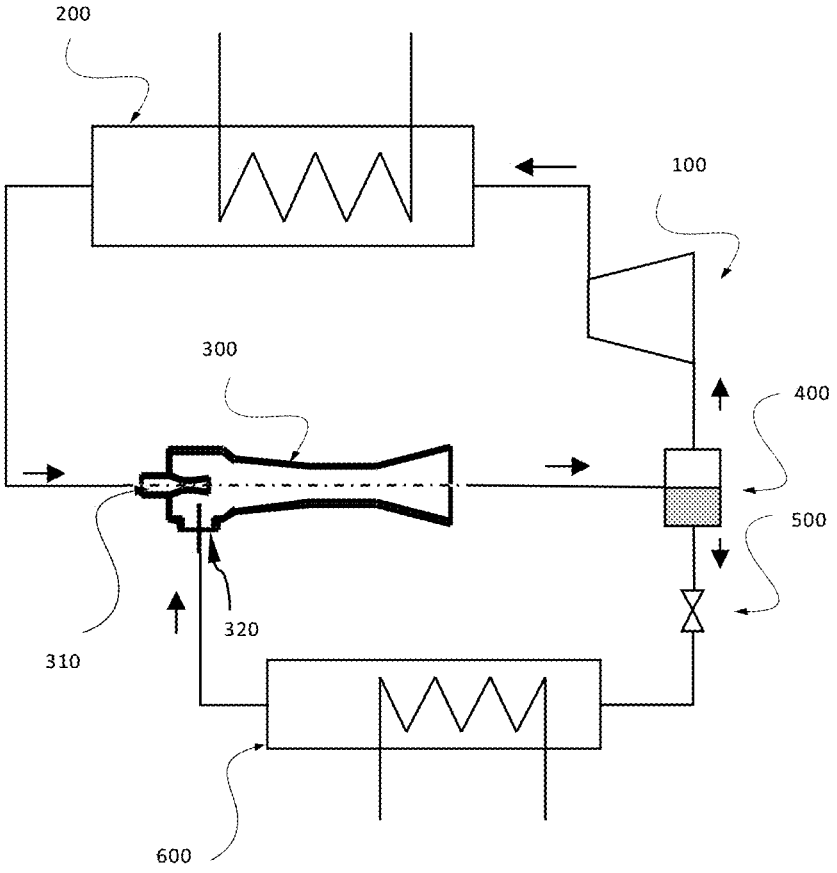
FIG. 1 shows a schematic diagram of a prior art cooling cycle system making use of a prior art ejector.

For a better understanding of the invention, a prior art cooling cycle system is shown in FIG. 1 and now described herein. A compressor (100) compresses a vapour phase refrigerant coming from a gas/liquid separator (400). After the compressor (100), a heat exchanger (200) is disposed where the refrigerant can be cooled down using a lower temperature fluid (not shown). The high-pressure fluid leaving the heat exchanger (200) enters the ejector (300) at a primary nozzle (310), typically in supercritical state. The liquid refrigerant from the bottom of a gas/liquid separator (400) is led through a pressure deducing device (500), e.g. valve. By the evaporation process in an evaporator (600) the cooling effect is produced when the refrigerant exchanges heat with air or another fluid (not shown). During this heat exchange, the working fluid (refrigerant) is evaporated and the temperature of air (or other fluid) is lowered. The produced low-pressure vapour is then entrained into the ejector (300) through a low-pressure side (320). In order to close the cooling cycle, the two streams (low-pressure and high-pressure streams) mix and get discharged to the gas/liquid separator (400).

Figure 2:
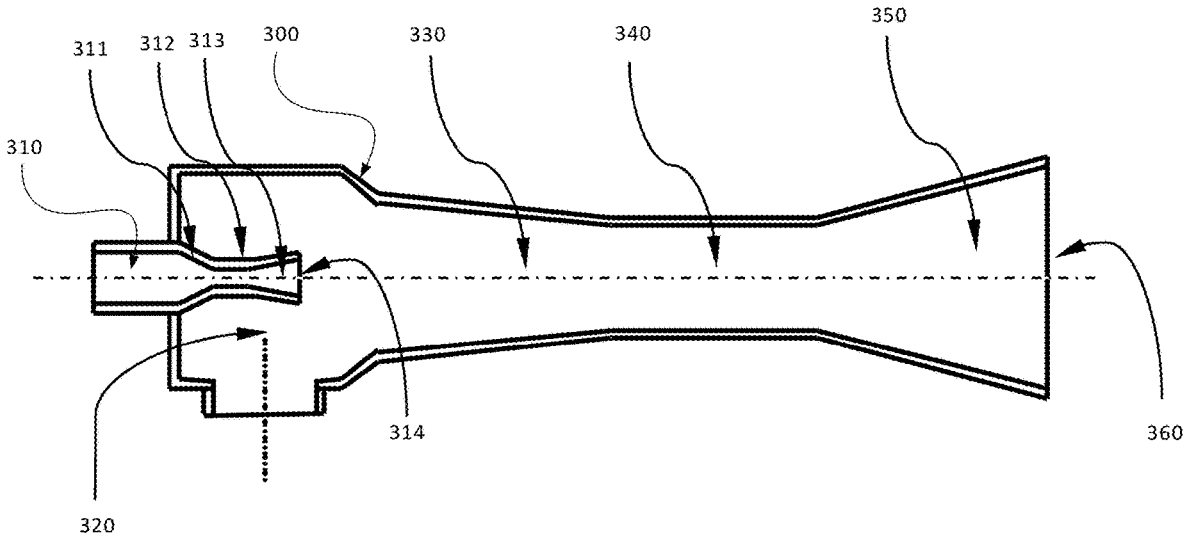
FIG. 2 is a schematic view of a prior art ejector.

The cross-section of a prior art ejector (300) is shown in FIG. 2. The ejector (300) is composed of a primary nozzle (310), a suction chamber (320), a tapered converging section (330), a constant area section (340) and a divergent diffuser (350). In operation, with further reference to FIG. 1, the high pressure or motive refrigerant stream, in supercritical or sub-critical state, coming from the heat exchanger (200) enters the primary nozzle (310) at low velocity. It gets accelerated in the tapered converging section (311) of the primary nozzle (310) towards the nozzle throat (312) where it reaches the speed of sound. After the nozzle throat (312), the refrigerant motive stream gets further expanded, thus it leaves the nozzle exit section (313) as a primary jet with high kinetic energy and low static pressure at subcritical state. This primary jet draws the low pressure (secondary) refrigerant stream coming from the evaporator (600) of the cooling cycle system (where the refrigeration effect takes place) through the suction chamber (320). Due to the large velocity difference between the motive and secondary fluids, a shear layer between the two streams develops that leads to the acceleration of the secondary stream. Under normal operation, the secondary fluid starts mixing with the primary flow after it reaches sonic speed in the tapered converging section (330). The mixing process after the primary nozzle exit section (313) is rather complex due to the interaction between the two fluid streams and the ejector wall. During this process the static pressure of the primary stream tends to gradually increase until it levels with the pressure of the secondary stream. After the mixing process is completed, a final shock occurs somewhere in the constant area section (340). The resulting flow becomes subsonic. The pressure is then further increased in the divergent diffuser (350) towards the outlet port (360). The refrigerant leaves the ejector through the exit as a liquid/vapour mixture.

FIG. 3 shows the preferred embodiment of a cooling cycle system comprising a variable geometry ejector (300). The invention is preferably suited for the implementation of a cooling cycle using environmentally friendly refrigerants (also called working fluids), such as R600a. The system requires considerably less electric power than the prior art ones since it does not require the use of a mechanical vapour compressor. The liquid refrigerant from the bottom part of a vapour separator (400) is divided into two streams: the primary stream (10) and the secondary stream (20). The primary stream (10) in compressed liquid state enters in a liquid pump (110) which increases the pressure of the refrigerant. The pump (110) discharges the refrigerant into a heat exchanger commonly called vapour generator (210). In the vapour generator (210) it receives heat from an external heat source (not shown) which is preferably provided from waste heat or solar thermal energy. The refrigerant in (saturated or superheated) vapour state and high pressure is transported through a connecting passage, for example a tube, to a primary inlet of the variable geometry ejector (300). The refrigerant can be at saturation or superheated state, depending on the nature of the refrigerant used. The secondary stream (20) is directed to an expansion device, such as an expansion valve (500), where it lowers its static pressure to the pressure determined by the evaporation temperature. Most of the evaporation takes place in a heat exchanger commonly called evaporator (600). In the evaporator (600) heat is removed directly from air or another fluid (not shown) by the secondary stream (20) of the refrigerant that is below the ambient temperature. The refrigerant discharges from the evaporator (600) as a saturated or slightly superheated vapour and enters the variable geometry ejector (300) on a secondary inlet side with low pressure and velocity. In the variable geometry ejector (300) the primary (10) and secondary (20) streams mix, and the pressure of the secondary stream (20) is increased to an intermediate level that is lower than the pressure at the primary inlet. The geometry of the variable geometry ejector is adjusted by command of a control unit (800). The spindle and the nozzle exit positions vary depending on the operating conditions. A mixed stream (30) in superheated vapour state enters a heat exchanger known as condenser (700) where it condenses by releasing energy to the outside air or another fluid (not shown). Then the refrigerant leaves the condenser (700) in liquid state, preferably with some degree (5-10° C.) of sub-cooling. After the condenser (700), the refrigerant goes through a vapour separator (400) in order to avoid damage of the pump (110) ahead due to cavitation effects in the presence of possible vapour bubbles (when sub-cooling is not present).

A cross-section view of a preferred embodiment of the variable geometry ejector (300) of the present invention is shown in FIG. 4. In this embodiment, the variable geometry ejector (300) comprises several parts forming the flow channel for the working fluid and actuators for adjusting the geometry of the ejector depending on the operating conditions.

For a better understanding of the variable geometry ejector (300) and its operation the flow path of the refrigerant flow is firstly explained hereinafter. The primary stream of the refrigerant enters into a primary fluid chamber (302) of the ejector (300) at high pressure and low velocity through the primary inlet (309). At the inlet (309), the refrigerant is in a single phase at saturated or superheated vapour state. A primary nozzle (310) in the primary chamber (302) comprises a tapered converging section (311), a throat (312) and a tapered divergent exit section (313) as shown in FIG. 5. The primary stream of the refrigerant is accelerated in the tapered converging section (311) and reaches choked conditions in the throat (312) (Mach number equal to 1). In the tapered divergent section (313), it further expands by increasing its velocity to supersonic flow and lowering its static pressure. The primary stream reaches its highest kinetic energy and lowest pressure at the exit (314) of the tapered divergent exit section (313). As the primary stream fans out of the primary nozzle (310), it entrains a secondary stream (20), coming from the evaporator (600), which is at saturated or slightly superheated vapour state, as already mentioned in connection with FIG. 3. It enters the variable geometry ejector (300) through a secondary inlet port (319) into the secondary (or suction) chamber (320), also at low velocity. The secondary stream (20) starts to accelerate in a tapered converging section (330) of the tail member (325). Under normal conditions, the secondary stream (20) reaches sonic velocity somewhere in the tapered converging section (330) and mixes with the primary stream (10) in the constant area section (340) of the tail member (325). Depending on the exit pressure, the mixed stream becomes subsonic by the end of constant area section (340) or in the beginning of the divergent diffuser (350) of the tail member (325). Then, the mixed refrigerant leaves the variable geometry ejector (300) through an outlet port (360) at an intermediate pressure and at a superheated vapour state. Thus, the refrigerant fluid travels through the ejector (300) in a single vapour phase.

An area ratio ($r_A$) between the cross-section of the constant area section (340) in the tail member (325) and the primary nozzle throat (312) can be changed by a movable spindle (308) arranged in the primary fluid chamber (302). The area ratio ($r_A$) varies between a finite value, determined by the cross-section area of the constant area section (340) and the primary nozzle throat (312) diameters, and infinite when the spindle tip (304) blocks the free passage of the working fluid at the throat (312).

Figure 6:
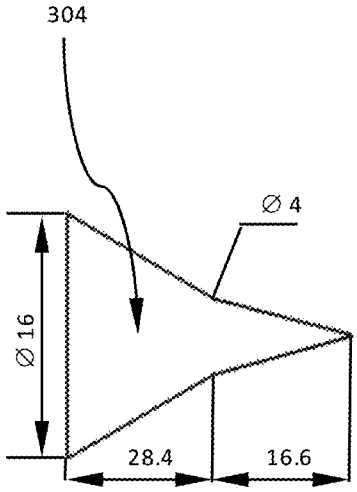
FIG. 6 is a detail of a preferred spindle tip used in connection with the ejector of the invention.

It has been found that preferably the half angle of the tapered converging section (311) of the primary nozzle (310) should be larger than the half angle of the spindle tip (304). In the exemplary embodiment, the half angle of the primary nozzle (310) is 30° and best results arose in a range between 20° to 40°. Accordingly, the spindle tip (304) can have a single half angle between 5° to 15°. However, as depicted in FIG. 6, a spindle tip design having two different angled parts is preferred, with a first smaller angle part and second larger angle part. The exemplary configuration of FIG. 6 shows a first smaller angle part with a half-angle of 7° and the second larger angle part with a half-angle of 12°.

Axial movement of the spindle (308) is achieved by actuation means (or actuators herein) such as an actuator/transmission mechanism. An exemplary actuation means is provided FIG. 7. In operation, the movable spindle (308) moves in the axial direction between two extreme positions. In the first extreme position, the spindle tip (304) positions outside the beginning of the tapered converging section (311) of the primary nozzle (310). In the second extreme position, the spindle tip (304) touches the wall of the nozzle throat (312) thus blocking the free passage for the working fluid in the primary nozzle (310).

Figure 7:
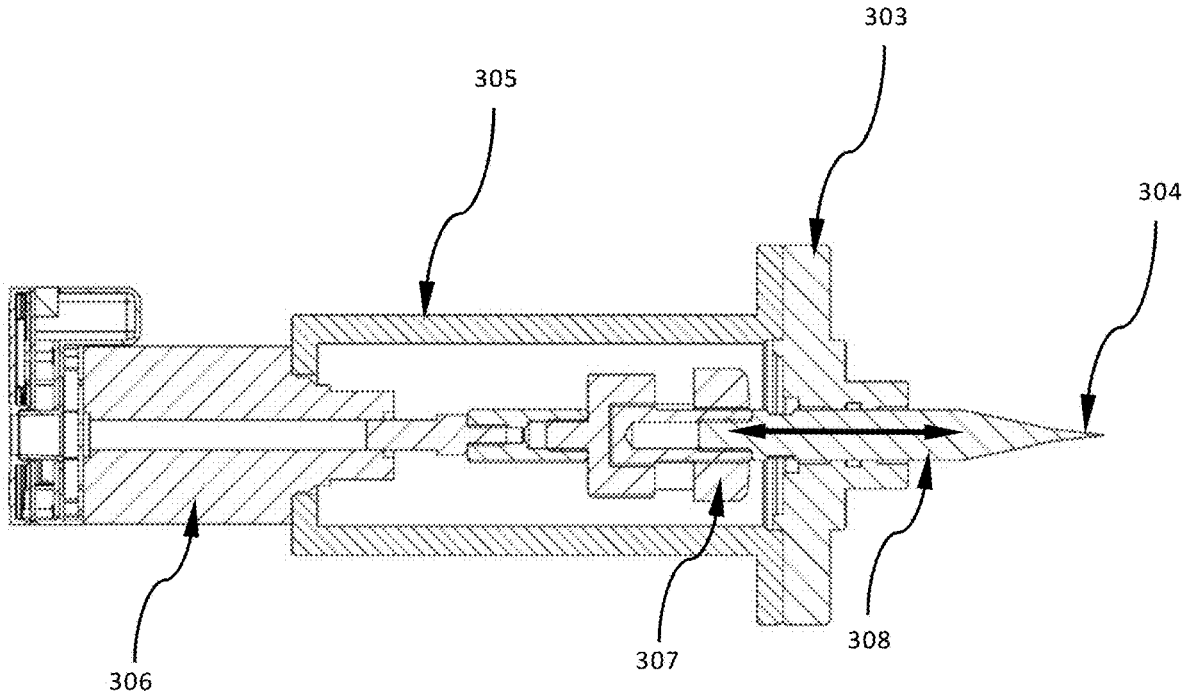
FIG. 7 is a detail of a preferred spindle moving mechanism of the variable geometry ejector of FIG. 4.

The proper alinement of the movable spindle (308) can be assured, for example, by a guiding and sealing plate (303) shown in FIG. 7. In the exemplary solution of FIG. 7, the mechanical connection between an exemplary stepping motor (306) and the movable spindle (308) is provided by transmission means (307) inside a transmission chamber (305). Other types of actuators can also be used to assure the axial motion of the movable spindle (308), e.g. mechanical actuator using the pressure of an inert gas (not shown).

The relative position (NXP) of the nozzle exit (314) in relation to the tail member (325) can be adjusted by the relative axial motion of the tail member (325) in relation to said nozzle exit (314), as shown in FIG. 6 when taken together with FIG. 4.

In this embodiment, the axis of the tail member (325) is aligned with the axis of the primary nozzle (310) by a housing of the suction chamber (320) and a support plate (355). In operation, during the axial adjustment of the NXP, the position of the suction chamber (320) and the support plate (355) remains unchanged. The axial movement of the tail member (325) is carried out by an actuator plate (370) attached to movable actuation bars (375), the rotating shaft (376) of an electric stepper motor (380) by the motor shaft plate (377). The adequate distance alignment of the electric motor (380) from the support plate (355) and its alignment it provided by the fixed support bars (378) and motor housing plate (390).

Automated control can be used to assist the operation of the variable geometry ejector of the invention. A control unit (800) such as for example an electronic controller provides for an optimized ejector and cooling cycle performance under variable operating conditions.

The invention claimed is:

1. A variable geometry ejector for cooling applications comprising, a primary fluid chamber, a suction chamber downstream the primary fluid chamber, a primary nozzle arranged so as to stream a working fluid from the primary fluid chamber to the suction chamber, a tail member arranged downstream the primary nozzle, and an NXP-adjustment means for moving any of the primary nozzle and the tail member in relation to the other wherein the NXP-adjustment means comprises an actuator plate attached to movable actuation bars, and a motor connected to the bars.

2. The variable geometry ejector according to claim 1, wherein the NXP-adjustment means further comprises a movable motor shaft plate connected to a rotating shaft of the motor and connected to the actuation bars.

3. The variable geometry ejector according to claim 1, wherein the primary fluid chamber is provided with a primary fluid inlet port, and the suction chamber is provided with a secondary fluid inlet port;

the primary nozzle comprises a primary tapered converging section, a throat and a tapered divergent exit section ending at a nozzle exit; and the tail member comprises a secondary tapered converging section, a constant area section and a diffuser section.

4. The variable geometry ejector according to claim 1 further comprising an $r_A$-shifting means arranged upstream the primary nozzle, wherein the $r_A$-shifting means is a movable spindle.

5. The variable geometry ejector according to claim 4, wherein the spindle is axially movable between a first position in which a spindle tip is arranged outside the tapered converging section of the primary nozzle, and a second position in which the spindle tip is inside the nozzle throat blocking the nozzle throat.

6. The variable geometry ejector according to claim 5, wherein said spindle tip has two different angled parts.

7. An ejector system comprising the variable geometry ejector according to claim 1.

8. The ejector system according to claim 7, further comprising a control unit.

9. The ejector system according to claim 8, further comprising a vapour generator, a condenser, a vapour separator, an expansion valve, an evaporator, a liquid pump and piping.

10. A variable geometry ejector for cooling applications comprising a primary fluid chamber, a suction chamber downstream the primary fluid chamber, a primary nozzle arranged so as to stream a working fluid from the primary fluid chamber to the suction chamber, a tail member arranged downstream the primary nozzle, and an NXP-adjustment means arranged for moving the tail member in relation to the primary nozzle exit of the primary nozzle and an $r_A$-shifting means arranged upstream the primary nozzle, wherein the NXP-adjustment means is selected from the group comprising mechanical actuator, electric actuator, electronic actuator, hydraulic actuator, pneumatic actuator and combinations thereof and wherein the $r_A$-shifting means is a movable spindle.

* * * * *